United States Patent [19]

Bogese, II

[11] Patent Number: 4,895,532

[45] Date of Patent: Jan. 23, 1990

[54] MODULAR CONNECTOR COUPLER WITH SELECTIVE COMMONING SYSTEM

[75] Inventor: Stephen B. Bogese, II, Roanoke, Va.

[73] Assignee: Virginia Patent Development Corporation, Roanoke, Va.

[21] Appl. No.: 97,342

[22] Filed: Sep. 11, 1987

Related U.S. Application Data

[63] Continuation of Ser. No. 858,837, Apr. 29, 1986, abandoned, which is a continuation of Ser. No. 652,653, Sep. 20, 1984, abandoned.

[51] Int. Cl.[4] ..... H01R 31/08

[52] U.S. Cl. ..... 439/507; 439/676; 439/638; 439/701; 439/731

[58] Field of Search ..... 439/676, 344, 638, 639, 439/650, 655, 656, 695, 696, 701, 708, 712–715, 731, 507, 509

[56] References Cited

U.S. PATENT DOCUMENTS

| | | | |
|---|---|---|---|
| 2,924,908 | 2/1960 | Hewes et al. | 339/210 M |
| 3,369,214 | 2/1968 | Krumreich et al. | 339/176 M |
| 3,482,201 | 12/1969 | Schneck | 339/14 R |
| 3,548,367 | 5/1969 | Bruetsch | 339/205 |
| 3,954,320 | 5/1976 | Hardesty . | |
| 4,082,409 | 4/1978 | Bailey et al. . | |
| 4,153,327 | 5/1979 | Johnson . | |
| 4,181,384 | 1/1980 | Dola et al. | 339/14 R |
| 4,268,109 | 5/1981 | Hardesty . | |
| 4,273,402 | 6/1981 | Hughes | 339/206 R |
| 4,274,691 | 6/1981 | Abernethy et al. . | |
| 4,367,908 | 1/1983 | Johnston . | |
| 4,379,609 | 4/1983 | Hardesty | 339/176 M |
| 4,460,234 | 7/1984 | Bogese | 339/205 |
| 4,464,003 | 8/1984 | Goodman et al. . | |
| 4,472,010 | 9/1984 | Parnello | 339/176 M |
| 4,555,151 | 11/1985 | Neese et al. | 339/17 CF |

OTHER PUBLICATIONS

PCT Application No. 83/03717, 10/27/83, Johnston et al., "Interface Connector", all pp.

*Primary Examiner*—David Pirlot

*Attorney, Agent, or Firm*—Saidman, Sterner, Kessler & Goldstein

[57] ABSTRACT

An improved modular connector coupler for joining two modular plugs features an improved spring contact portion and a selective, continuous commoning system. The spring contact portion of the conductors substantially increases the area of contact with the mating plug's terminals, and prevents overstressing of the conductors. The permanently installed commoning bar assembly provides continuous electrical connection between two or more of the main conductors in such a manner that micromovements of the conductors are easily followed and do not cause open circuits. The housing structure features two substantially identical housing halves which are connected back-to-back in a 180° rotated configuration.

14 Claims, 4 Drawing Sheets

4
6
12'
12
14
16
18
20
22
24
26
28
30
32
34
36
38
39
40
41
42
44
46'
48'
52'
54
56
58'
60'
62'
64
80'
80³
80¹⁰
81'
82
84
86
86a
88
92
92a
94
94a
96
98
100
100'
106
110
110'
124
126
132
134
134'
136
140
140'

MODULAR CONNECTOR COUPLER WITH SELECTIVE COMMONING SYSTEM

This application is a continuation of application Ser. No. 858,837, filed Apr. 29, 1986 now abandoned, which was a continuation of application Ser. No. 652,653 filed 9/20/84, now abandoned.

BACKGROUND OF THE INVENTION

1. Field of the Invention

The present invention is related to electrical connector receptacles commonly known as modular jacks and, more particularly, is directed towards a double-ended modular jack or coupler for use as an interconnect device between two multi-conductor cables, each terminated by a modular plug.

2. Description of Related Art

The desirability of providing a double-ended connector receptacle or modular jack for end-to-end connection of modular plugs has been recognized in the following U.S. Pat. Nos. 4,153,327; 4,268,109; 4,273,402; 4,367,908; and 4,379,609. The couplers taught in these patents are characterized by the provision of a dielectric housing and a pair of cavities opening into each end thereof. Each cavity is particularly designed and sized to receive a mating modular plug of the type described, for example, in U.S. Pat. No. 3,954,320 to Hardesty. Modular plugs and jacks have gained wide acceptance in the communications industry, as well as for use with general electrical and electronic equipment as interconnect devices.

An improved double-ended modular jack is described in U.S. Pat. No. 4,460,234, assigned to the same assignee as the present invention. In the '234 patent, a plurality of side-by-side conductors are employed which have a greatly reduced length compared with the conductors of the previously known couplers. This results in substantial cost savings both with respect to the overall reduced length of the conductors themselves, as well as with respect to the reduced amount of gold-plating thereof which is provided to increase conductivity and reliability.

While an improvement over prior known designs, the coupler described in the '234 patent nevertheless has a few drawbacks of its own. For one thing (and this is a problem which is common to all previously known modular jacks), the design of the spring contact portions of the conductors provides only a small area of electrical contact with the contact terminals of the male modular plug. Prior art modular jacks utilize a linear (or slightly curved) diagonally extending spring contact portion that makes contact with only the crown, or radiused end, of the contact terminal of the modular plug. This results in essentially a single point of electrical contact between the two components of approximately 0.0008 inch in diameter. Several problems arise from this configuration. For one thing, when the conductors are carrying high frequency signals (e.g., 20–40 MHz.), some information can be lost due to the small area of contact (i.e., signal transfer area) between the plug and jack conductors.

Another problem with such spring contact configurations is that they do not provide a uniform contact resistance as the plug is inserted and withdrawn into and from the jack. This results from the fact that such spring contact portions have a longitudinal force vector which increases and thus creates more resistance to longitudinal movement of the plug as the plug is inserted more deeply into the plug-receiving opening of the jack. Conversely, the contact resistance lessens as the plug is withdrawn from the cavity.

The single point of contact between the jack's spring contact portion and the plug's contact terminal is also disadvantageous when the connectors are utilized in an environment which is subject to vibration. In such a case, electrical continuity may be intermittently and undesirably broken.

A further disadvantge of the prior art spring contacts is that they may be easily overstressed if the wrong size plug is accidentally inserted into the jack. Such overstress degrades contact reliability and essentially ruins the jack for subsequent use.

In addition to the foregoing, the prior art couplers make no provision for selectively but permanently commoning two or more conductors in order to minimize the number of contact positions and wires required on one end of the coupler to carry a particular signal (such as tip or ring) that may come in on the other end of the coupler in more than one position. While the '234 patent does teach a shorting bar arrangement (see FIGS. 7 and 8 and column 7 from line 34), the shorting bar only comes into play when the modular plug is withdrawn from the coupler; it is ineffective when the modular plugs are mated in the double-ended jack. I have discovered that it would be very desirable to provide a double-ended modular jack with the capability of selectively and permanently commoning two or more conductors regardless of whether the modular plugs are in place in the jack.

The present invention is provided to overcome the above-noted deficiencies and as an improvement over known modular jack couplers.

SUMMARY OF THE INVENTION

The foregoing and other objects and advantages are provided in accordance with one aspect of the present invention through the provision of a modular connector for coupling two modular plugs, which comprises a dielectric housing having first and second ends, a central housing portion, and first and second plug-receiving cavities extending inwardly from the first and second ends, respectively. The first and second cavities are adapted to receive first and second modular plugs therein, respectively, and the housing includes a plurality of side-by-side conductor-receiving guide means located in the central housing portion.

Each of the modular plugs terminates a multi-conductor cord by means of a plurality of side-by-side, substantially planar, insulation-piercing contact terminals positioned in the forward portion of the plug, the contact terminals including a substantially flat outer edge surface.

The invention further includes a plurality of electrical conductors positioned in a side-by-side spaced apart fashion in the housing. Each of the conductors include a central portion and first and second spring contact portions extending generally outwardly from respective ends of the central portion into the first and second cavities, respectively, towards the first and second ends of the housing. The conductor-receiving guide means include means for supporting the central portions of the conductors. Each of the spring contact portions preferably includes a substantially linear beam mating portion.

The outer edge surface of the contact terminals of the modular plugs engage the linear mating portions of the spring contact portions of the conductors after insertion of the plugs into the cavities, and the free ends of the first and second spring contact portions deflect outwardly upon making and breaking of electrical contact with the contact terminals of the plug.

In one embodiment, the conductors may comprise stamped and formed contacts, the linear mating portion of the spring contact portion in this case including a substantially flat outer surface for contacting the flat outer edge surface of the contact terminal whereby the resultant contact area between the spring contact portion and the contact terminals when in normal alignment comprises a quadrilateral. In an alternate embodiment, the conductors may comprise round wires whereby the resultant contact area between the spring contact portion and the contact terminal when in normal alignment comprises a substantially thin, elongated line.

In accordance with more detailed aspects of the present invention, the spring contact portion further includes a leg portion and a free end portion, the leg portion extending between the central portion and the linear mating portion, the spring contact portion terminating in the free end portion. The inner top wall of the each of plug-receiving cavities has a plurality of side-by-side slot means formed in alignment with the conductor-receiving guide means, the leg portions of the spring contact portions extending partially within the cavities and partially within the slot means. The free end portions of the spring contact portions are freely movable in the slot means upon insertion and withdrawal of the modular plugs into and out of the cavities. The linear beam mating portions of the first and second spring contact portions in one embodiment face opposite directions whereby the signals from the contact terminals of the first and second modular plugs will be positionally matched.

In accordance with yet another aspect of the present invention, the angular orientation of the linear mating portions of the spring contact portions in the cavities is such that the modular plugs when inserted into the cavities causes the linear mating portions to become substantially parallel with the longitudinal axis of the cavities. Stated another way, the linear mating portions of the spring contact portions are oriented at a slight angle (e.g., 5°) to the longitudinal axis of the cavities prior to insertion of the modular plugs into the cavities. Each of the spring contact portions may further include a diagonal portion extending between the linear mating portion and the free end portion. Furthermore, the contact terminals of the modular plugs include at least one crown formed at the forwardmost end of the flat, elongated outer edge surface, and the diagonal portion of the spring contact portion is angled in the cavity to make initial contact with the forwardmost crown upon insertion of the contact terminal into the cavity, the crown urging the spring contact portion upwardly as the modular plug is inserted further into the cavity.

In accordance with yet other aspects of the present invention, the conductor-receiving guide means are formed at a height above the inner top wall of the cavity. The central portions of the conductors lie in a plane which is spaced above the plane of the inner top wall of the cavity, and the conductor-receiving guide means comprise a plurality of side-by-side channels extending longitudinally in the central housing portion. The channels preferably include means for restraining the conductors against longitudinal movement which, in turn, comprise a transverse set of retaining partitions and apertures formed across the channels and adapted to receive retaining tabs formed in the conductors at the approximate midpoint thereof.

In accordance with yet another important aspect of the present invention, the housing further comprises means for accommodating a commoning bar assembly located underneath partition and groove means. The accommodating means preferably comprises a channel extending tranversely to the partition and groove means. A first commoning bar assembly is provided underneath the central portion of the conductors in the channel. The first commoning bar assembly preferably includes means for electrically coupling two or more of the overlying conductors. In a preferred form, the coupling means comprises an elongated center conductive strip, a plurality of commoning fingers extending upwardly and outwardly from the strip, and means for retaining the strip in the channel. The fingers are in constant spring contact with those of the conductors that respectively overlie the fingers. A second channel may be formed in each of the housing halves for accommodating a second commoning bar assembly that is substantially identical to the first commoning bar assembly.

In accordance with yet another aspect of the present invention, there is provided a modular jack for receiving a modular plug of the type which includes a dielectric housing having a free end for insertion into the modular jack, a cord input end having a cavity for receiving a multi-conductor cord, a resilient latching arm integrally connected by a flexible hinge to the free end of the dielectric housing and extending obliquely rearwardly therefrom, a terminal-receiving side having partitions which define side-by-side slots in communication with the cavity, electrically conductive contact terminals positioned within the slots and extending into the cavity for making electrical engagement with associated conductors of the cord and for making electrical contact external to the plug, the contact terminals including insulation-piercing tangs at the lower portion thereof and an outer edge surface. The modular jack comprises an insulating housing having a front end and a rear end, plug-receiving cavity means for receiving the modular plug extending into the front end of the insulating housing and having a plurality of internal walls including a rear wall, a supporting wall extending adjacent the rear wall and having conductor-receiving means formed therein, a plurality of electrical conductors in side-by-side spaced-apart relationship, each of the conductors comprising a first portion positioned in the conductor-receiving means of the supporting wall and a spring contact portion extending from the first portion into the plug-receiving cavity means, commoning bar assembly means positioned adjacent the conductor-receiving means of the supporting wall and including means for maintaining continuous electrical contact between at least two of the plurality of electrical conductors, the spring contact portions of the conductors engaging the contact terminals of the modular plug after insertion of the plug into the cavity means, the plug-receiving cavity means further having recess means formed therein for receiving and releasably retaining the latching arm of the modular plug.

In accordance with more detailed aspects of the invention, the means for maintaining continuous electrical contact preferably comprises at least two fingers in spring contact engagement with the two electrical conductors. The commoning bar assembly means further comprises an elongated conductive strip extending transversely adjacent the first portions of the conductors, the two fingers extending integrally from the strip. Means for mounting and retaining the commoning bar assembly in the insulating housing are also provided.

BRIEF DESCRIPTION OF THE DRAWINGS

The foregoing and other objects, aspects, features and advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
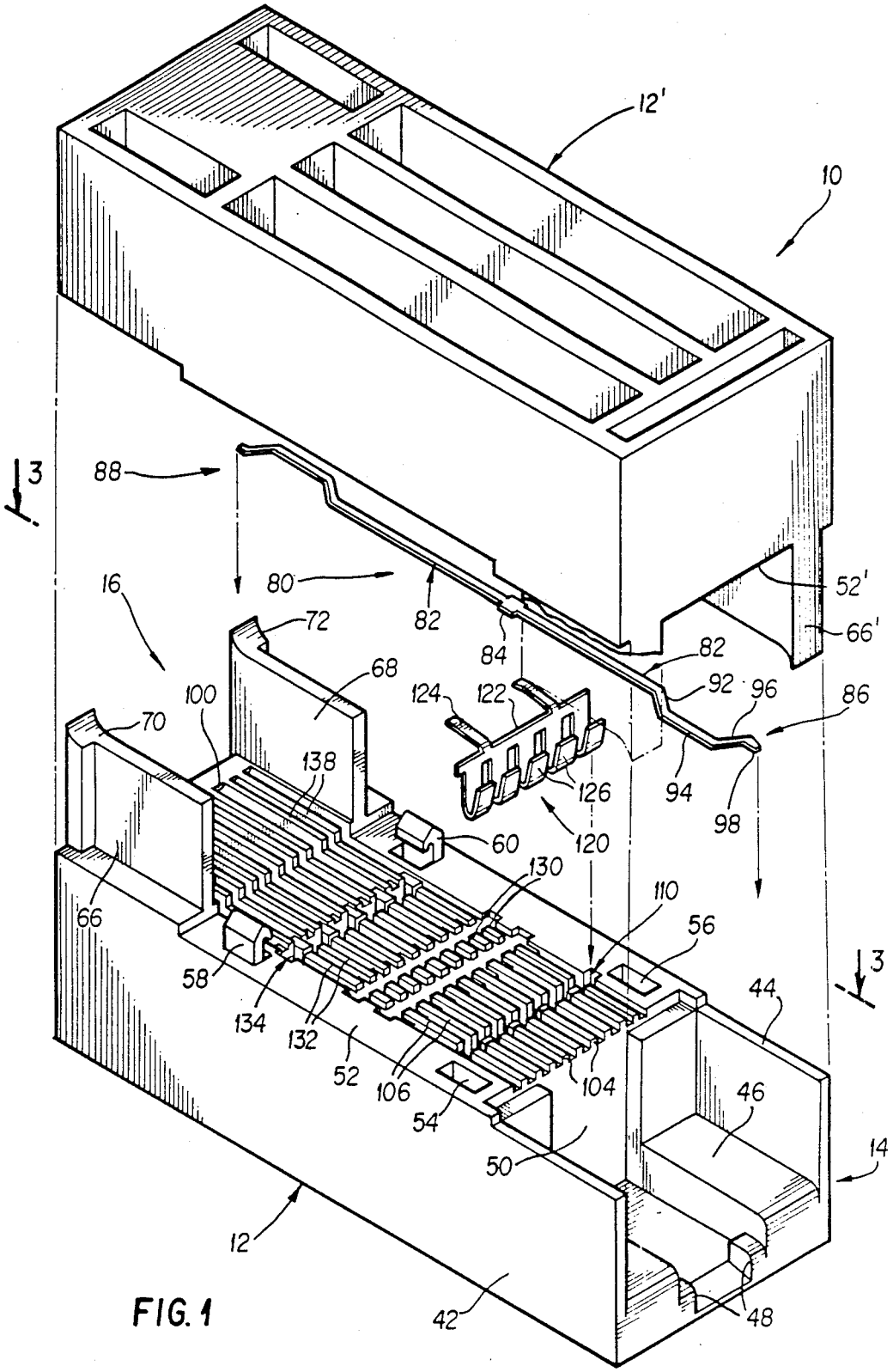
FIG. 1 is an exploded, perspective view illustrating a preferred embodiment of the modular connector coupler of the present invention.
Figures 2, 2A, 6:
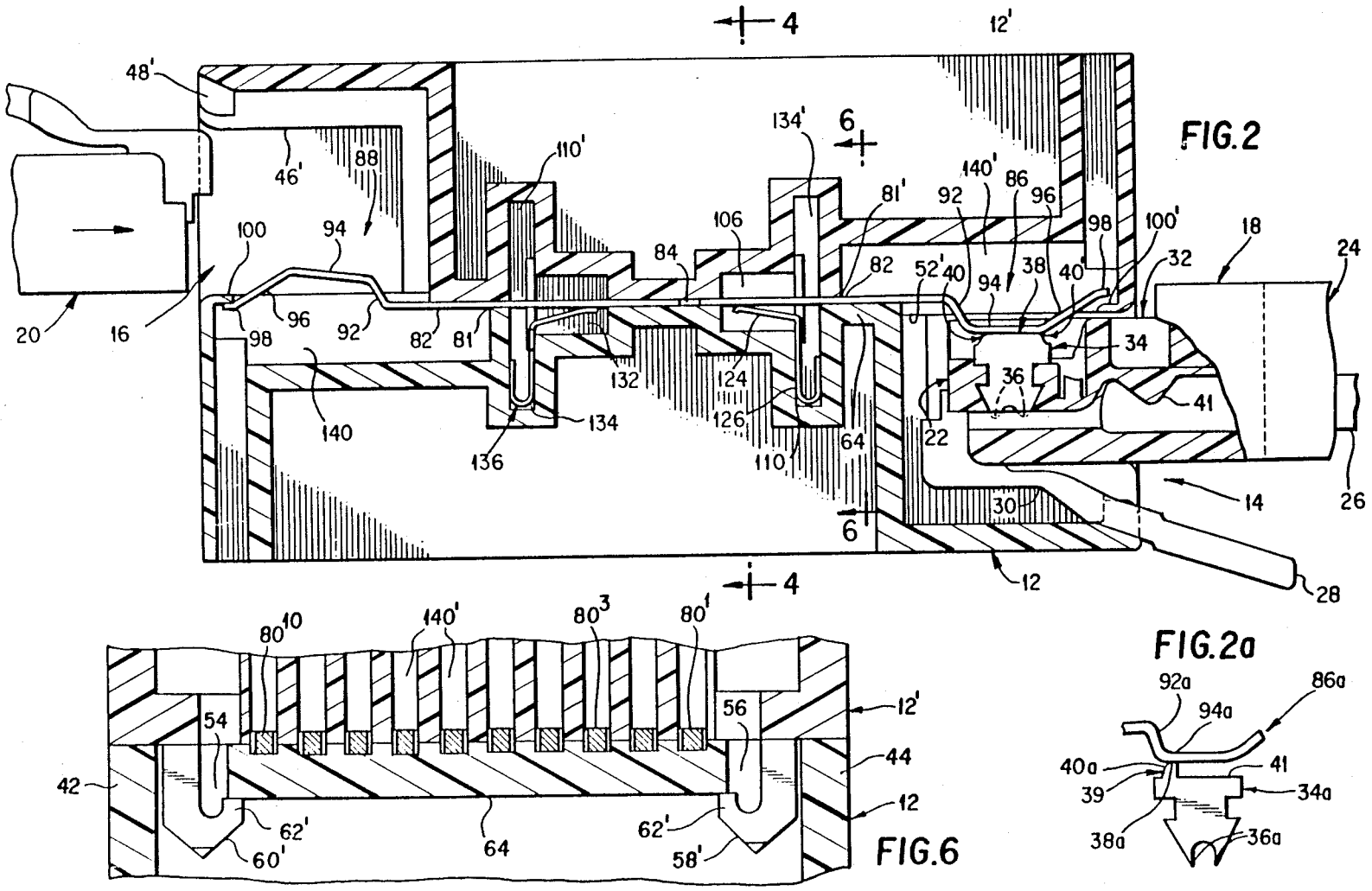
FIG. 2 is a longitudinal sectional view of the preferred embodiment of the present invention and which also illustrates the modular plugs with which the present invention is utilized.
FIG. 2*a* illustrates an alternate embodiment of a contact terminal for a modular plug together with a portion of the spring contact of the present invention.
FIG. 6 is an enlarged, cross-sectional, broken view taken along line 6—6 of FIG. 2.

Referring now to the drawings, wherein like reference numerals represent identical or corresponding parts throughout the several views, and more particularly to FIGS. 1 and 2 thereof, the modular connector coupler with selective commoning system is indicated generally by reference numeral 10. Coupler 10 includes a pair of substantially identical dielectric housing halves 12 and 12'. It is noted that the "lower" housing half 12 is rotated 180° with respect to the "upper" housing half 12' prior to joining the two halves. Throughout this specification, for ease in identification, unprimed reference numerals will be utilized to indicate components of the lower housing half 12, while primed reference numerals will indicate corresponding components of the upper housing half 12'.

When the identical housing halves 12 and 12' are joined (see FIG. 2), the overall coupler 10 forms at each end a pair of openings or cavities 14 and 16 sized to receive a pair of modular plugs 18 and 20, respectively. The modular plugs 18 and 20 are of the type generally described, for example, in the following U.S. Pat. Nos. 3,860,316; 3,954,320; 3,998,514; and 4,002,392, the disclosures of which are expressly incorporated herein by reference.

Referring particularly to FIG. 2, each modular plug, such as modular plug 18, is generally characterized by a dielectric housing having a free end 22 for insertion into modular jack cavity 14. Plug 18 also includes a cord input end 24 having a cavity formed therein for receiving a multi-conductor cord 26. Modular plug 18 is further characterized by the provision of a resilient latching arm 28 integrally connected to the free end 22 of the housing by a flexible hinge 30. Latching arm 28 extends obliquely rearwardly from the free end 22.

Modular plug 18 is further characterized by a terminal receiving side 32 having a plurality of parallel partitions formed therein that define side-by-side slots. Each slot is particularly designed to receive and retain a substantially flat, conductive, generally phosphor-bronze gold-plated contact terminal 34. Each contact terminal 34 is, in turn, characterized by a pair of insulation-piercing tangs 36 which extend from the lower portion thereof for piercing the insulation and making contact with an insulated wire of multi-conductor cord 26. Contact terminal 34 is further characterized by an upper, generally flat, elongated outer edge surface 38 which, in the preferred embodiment of the present invention, serves as the external contact portion for modular plug 18. Upper edge surface 38 is generally rectangular (approximately 0.077 inch long and 0.012 inch wide) and is defined on both sides by the generally parallel side walls of the contact 34, and a pair of curved portions or crowns 40 and 40' formed one at each end of flat edge surface 38. The forwardmost crown 40 is formed at a predetermined radius and is adapted to make initial contact with the conductors of the jack, as is described in my copending application Ser. No. 882,434, assigned to the same assignee as the present invention, the specification of which is specifically incorporated herein by reference. Modular plug 18 may also be provided with a retaining bar 41, as is conventional, which serves as a strain relief mechanism for multi-conductor cord 26.

Referring to FIG. 2*a*, there is shown an alternate configuration for a contact terminal 34*a* for modular plug 18. Contact terminal 34*a* is similar to terminal 34 and includes the customary insulation-piercing tangs 36*a*. The upper contact surface 38*a* of contact terminal 34*a* is preferably flat and extends, however, only on the top portion of a relatively short protrusion 39 having a forwardmost crown or radiused end 40*a* substantially identical to crown 40 of the first embodiment. Protrusion 39 drops off rapidly to a flat, lower edge 41 that extends to the rear end of terminal 34*a*. The length of outer edge surface 38*a* may range, for example, between 0.005–0.015 inch, and is typically about 0.007 inch. The thickness of terminal 34*a* remains about 0.012 inch. This configuration dispenses with the rear crown and saves substantially on gold-plating costs.

Returning again to FIG. 1, each housing half, for example lower half 12, includes outer side walls 42 and 44 between which extend a bottom wall 46 which forms the floor for the plug-receiving cavity 14. A pair of spaced locking tabs 48 are provided for releasably retaining the latching arm 28 of mating modular plug 18. In addition to bottom wall 46, cavity 14 is defined by a rear wall 50. Housing half 12 further includes a top wall 52 which is designed to mate adjacent to the opposed top wall 52' of upper half 12'. Top wall 52 acts as a supporting wall for the electrical conductors that are positioned in conductor guide means formed therein, as will be described in greater detail hereinafter.

A pair of apertures 54 and 56 are formed in top wall 52 adjacent the rear wall 50 of cavity 14. Apertures 54 and 56 are sized to receive a pair of locking hooks 58' and 60' of the upper housing half 12'. Hooks 58' and 60' are snap-fit into apertures 54 and 56. As seen more clearly in FIG. 6, each locking hook preferably comprises a somewhat J-shaped member of a width greater than the width of apertures 54 and 56. Each hook further includes a free end 62 that is compressed slightly when the hook is inserted through its respective aperture until it snap-fits under a lower ledge 64 of housing half 12.

Referring back to FIG. 1, at the other end of top wall 52, located inwardly of side walls 42 and 44, are formed a pair of vertical inner side walls 66 and 68 which form the side walls for plug-receiving cavity 16 after the lower and upper housing halves 12 and 12' are joined. Inner side walls 66 and 68 include curved lower surfaces 70 and 72 for mating with the curved bottom wall 46' of upper housing half 12'.

Figure 7:
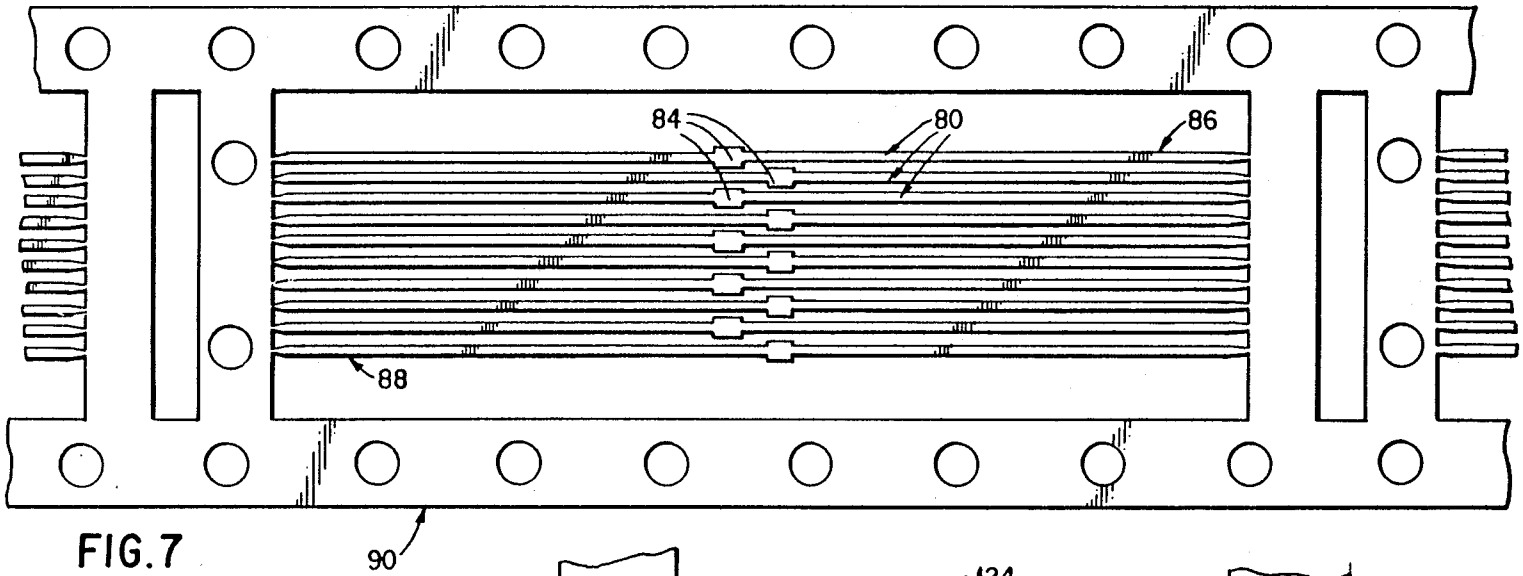
FIG. 7 is a plan view of a first lead frame utilized with the present invention.

Located on top wall 52 are a plurality of side-by-side conductor-receiving guide means to be described in greater detail hereinafter, for receiving, separating, and positioning a plurality of elongated, preferably stamped-and-formed electrical conductors such as the illustrated conductor 80 of FIG. 1. Conductor 80 includes a central portion 82 having a sideways-enlarged positioning tab 84 located at the approximate midportion thereof. Extending from each end of the central portion 82 of conductor 80 are a pair of spring contact portions indicated generally by reference numerals 86 and 88. Conductors 80 are preferably stamped and formed from a lead frame 90 such as illustrated in FIG. 7. It may be appreciated from FIG. 7 that positioning tabs 84 are formed in an alternating, staggered array on adjacent conductors. After the conductors 80 are severed from the lead frame 90, forming tools are utilized to shape the spring contact portions 86 and 88 in a manner to be described in greater detail hereinafter.

As seen in FIGS. 1 and 2, and as described in greater detail in my copending application Ser. No. 882,434, each of the spring contact portions, such as spring contact portion 86, is defined by a first somewhat diagonal leg 92 that extends from central portion 82 angularly downwardly (as viewed in FIG. 1) and somewhat forwardly into plug-receiving cavity 14 to a position below inner top wall 52'(see FIG. 2). Leg 92 could be substantially vertically oriented as well. Extending forwardly from leg 92, and slightly downwardly when unstressed (see spring contact 88 in FIG. 2) is a linear beam mating portion 94 whose lower surface (as seen in FIG. 2) serves as the contact surface for mating with the contact terminal 34 of modular plug 18. In the preferred embodiment, wherein the conductors 80 comprise stamped and formed contacts, the bottom surface of linear mating portion 94 is substantially flat and elongated and is adapted to mate with the flat, linear top surface 38 of contact terminal 34. This substantially increases the contact area therebetween compared with earlier designs, in a manner to be described in greater detail hereinafter.

Spring contact portion 86 further includes a second diagonally extending leg 96. Leg 96 is formed at a shallow enough angle so that it is initially engaged by the forwardmost crown 40 of contact terminal 34 as the latter is inserted into plug-receiving opening 14. Diagonal leg 96 terminates in the non-mating free end 98 of conductor 80 which is angled horizontally, substantially parallel with central portion 82, and is adapted to rest in repose on lip 100' of housing half 12'. The non-mating free end 98 is non-colinear with the substantially linear mating portion 94.

It is noted from the left side of FIG. 2 that the linear beam mating surface 94 of spring contact portion 88 of conductor 80 is set at a slight angle with respect to the longitudinal axis of cavity 16 prior to entry of plug 20 into cavity 16. The angle may be, for example, approximately 5 degrees. This design ensures that beam 94 will rest in maximum contact with the flat upper surface 38 of contact terminal 34 of plug 20 after full insertion of plug 20 into opening 16 (such as shown in FIG. 2 between plug 18 and spring contact 86).

In the alternate contact terminal embodiment of FIG. 2*a*, the linear beam 94*a* of spring contact 86*a* also makes maximum contact with the available upper contact surface 38*a* of protrusion 39, even though the resultant contact area will be substantially less than that of the embodiment of FIG. 2.

Referring back to FIG. 2, upon initial insertion of plug 20 into opening 16, the forwardmost crown 40 of the contact terminal will make contact with diagonal 96 as described above. It is important that the crown initially contact diagonal 96, and not the sharp edge adjacent crown 40, because the gently radiused edge of crown 40 will not scratch or mar the gold plating of conductor 80. Upon further insertion of plug 20, crown 40 serves to move spring contact portion 88 by pivoting against a fulcrum formed by edge 81 of housing half 12. Further insertion of plug 20 will move spring contact portion 88 until its flat mating surface 94 is in electrical engagement with the opposed flat surface of the contact terminal of the plug, as illustrated between modular plug 18 and spring contact portion 86 in FIG. 2. When fully mated, the portion of central portion 82 of conductor 80 that is positioned forwardly of fulcrum edge 81' is slightly raised off the top wall 52 of housing half 12, and the free end 98 is raised off the lip 100' of upper housing half 12'.

Figure 9:
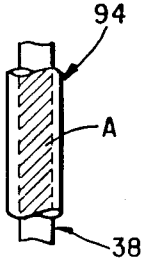
FIG. 9 is a diagrammatic sketch illustrating the intersection of a spring contact portion of a conductor of a jack with the contact terminal of the plug.

FIG. 9 is a diagrammatic view illustrating the mating condition of the flat portion 94 of the spring contact 86 and the flat portion 38 of the contact terminal 34. The flat portion 38, as can be seen from the drawings, has more than one point of contact (at least first and second points of contact) with the flat portion 94 of spring contact 86. The width or thickness of the flat spring contact portion 94 is approximately 0.017 inch, while the width or thickness of the plug's contact terminal at edge 38 is approximately 0.012 inch. Thus, the shaded area of intersection A between edge 38 and edge 94, when the components are in normal alignment, approximates a quadrilateral figure—in this case, a rectangle. The contact area A is a substantial increase over the point contact area provided by prior art designs. By "normal alignment", it is meant that the longitudinal axis of the spring contact portion lies substantially parallel to the longitudinal axis of the cavity 14 which, in turn, is substantially parallel with the plane formed by contact terminal 34. Of course, contact terminal 34 and/or spring contact portion 86 may be angled or skewed with one another during use, which could create a somewhat irregular area of contact between the two, as may be appreciated. However, in most instances, the resultant area of contact will be substantially greater than the single point contact areas of prior art modular connector designs.

In the alternate contact terminal embodiment of FIG. 2*a*, the area of intersection is also a quadrilateral and, although it will be a substantially smaller quadrilateral than shown in FIG. 9, it still exceeds the point contact area of the prior art. The contact terminal 34*a* is more likely to be used in those applications where impedance matching is not as important as other factors, such as in normal telephone use.

Figure 10:
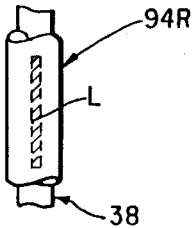
FIG. 10 is a view similar to FIG. 9 but illustrating an alternate construction.

FIG. 10 illustrates an alternate configuration wherein the stamped-and-formed contact portion 94 of FIG. 9 is replaced by a drawn, round wire 94R. In this instance, the area of contact, in normal alignment, will be defined by a line L, which, although less than area A of FIG. 9, is nevertheless a substantial improvement over known point contact areas.

Figure 5:
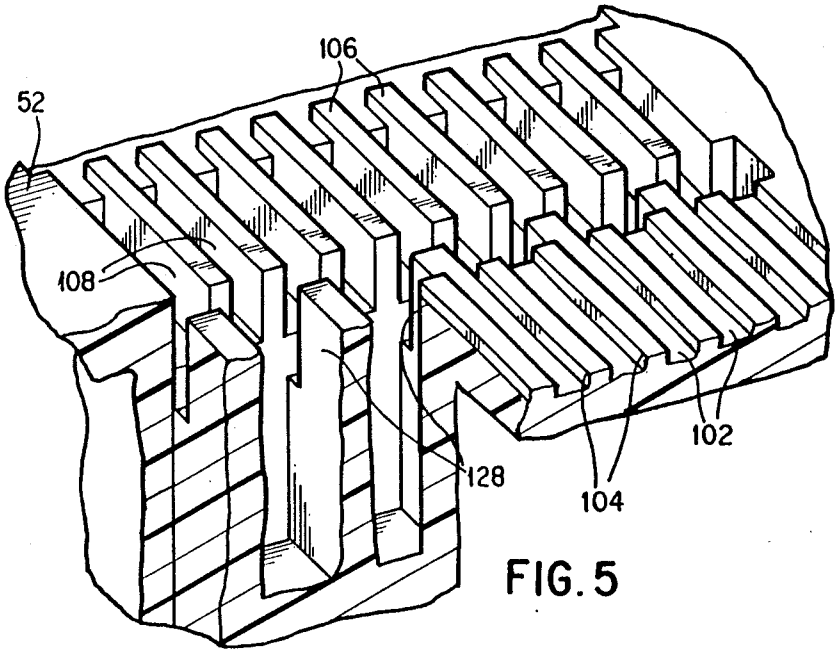
FIG. 5 is an enlarged, perspective, broken view of the slot, partition and groove assembly of the present invention.

Referring now to FIGS. 1 and 5, formed in top wall 52 of housing half 12, between apertures 54 and 56, are a first plurality of conductor-receiving means comprising grooves 102 separated by a first set of partitions 104. Ten sets of grooves 102 and partitions 104 are illustrated in this embodiment for receiving ten side-by-side conductors 80 therein.

Aligned with but spaced from the first set of partitions 104 is a second set of partitions 106 between which are formed side-by-side slots 108 adapted to receive not only the conductors 80 but commoning fingers 124, to be described in greater detail hereinafter.

Positioned between the first and second set of partitions 104 and 106 is a recess 110 which extends the full width of partitions 104 and 106. Recess 110 is sized to receive a commoning bar assembly which is indicated generally by reference numeral 120. Commoning bar assembly 120 comprises, as seen perhaps best in FIG. 8, a conductive lead frame 121 from which is stamped a transverse center conductive strip 122 and a plurality of commoning fingers 124. In this embodiment, ten such fingers 124 are spaced to accommodate up to ten conductors of the main conductor lead frame 90. Extending from the other side of transverse center strip 122 are a plurality of (e.g. five) mounting legs 126.

Figure 8:
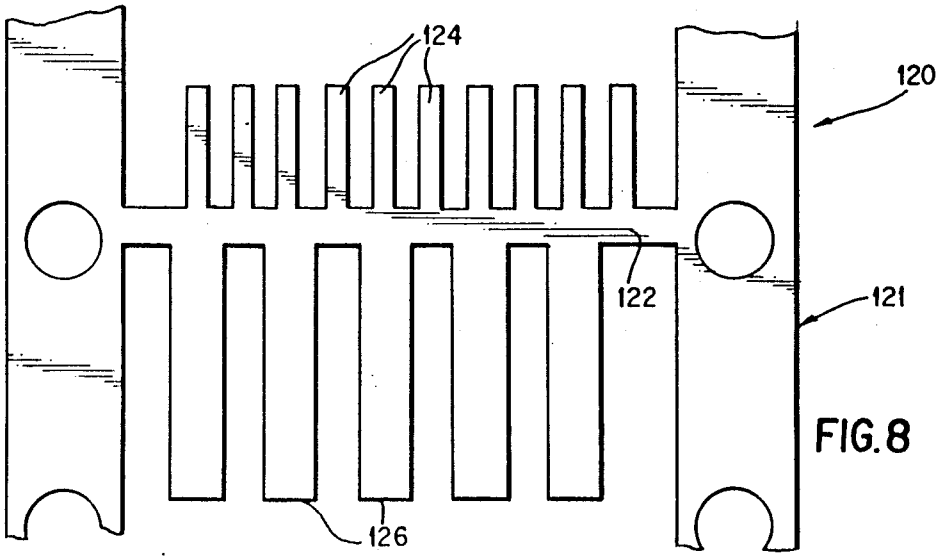
FIG. 8 is a plan view of a second lead frame also used with the present invention.

As may be appreciated from comparing FIG. 8 with FIGS. 1 and 2, after being severed from lead frame 121, legs 126 are formed into a substantial U-shape for fitting within recess 110, while commoning fingers 124 are bent in almost a 90° angle with respect to U-shaped legs 126, so as to extend forwardly and slightly upwardly to act as spring contacts for the main conductors 80. Prior to insertion of the commoning bar assembly 120 into recess 110, selected fingers 124 are severed from strip 122 to leave fingers only in preselected positions for shorting the preselected main conductors 80 positioned thereabove, as will become more clear hereinafter.

As seen in FIGS. 1 and 5, every other groove 102 extends into recess 110 to form, in this embodiment, four dividers 128 to define five pockets for receiving the five mounting legs 126 of commoning bar assembly 120. The non-severed fingers 124 reside in slots 108 below central portions 82 of conductors 80. The construction and installation of commoning bar assembly 120, together with the provision of spring contact fingers 124 thereof, provides a semi-rigid base to allow spring contact fingers 124 to maintain proper electrical connection with the overlying portion of conductors 80 even though the latter may shift in position, especially as the modular plugs 18 and 20 are inserted and withdrawn. Thus, spring contact portions 124 form flexible, movable contacts for the commoning bar assembly 120 that provide increased electrical reliability in that they are always in electrical engagement with the overlying conductors 80 from the main lead frame.

The central portion of top wall 52 of lower housing half 12 includes a plurality of dividers 130 which accommodate the positioning tabs 84 of conductors 80 to maintain the latter in proper longitudinal position in the housing.

Also positioned on top wall 52 are a second set of side-by-side partitions 132 (and associated slots) and a transverse recess 134 which are substantially identical to partitions 106 and recess 110, respectively. The second set of partitions, slots, and recess are designed to accommodate a second commoning bar assembly 136 (see FIGS. 2 and 3), if desired. The second commoning bar assembly 136 may be designed to electrically connect different conductors 80 than the first commoning bar assembly 120, as will be explained more fully below.

Finally, positioned between walls 66 and 68 and extending to the recess 134 are a plurality of walls or partitions 138 which form side-by-side slots 140 within which the spring contact portions 88 of conductors 80 move during insertion and removal of the modular plug 20 in cavity 16. It is understood that corresponding housing half 12' includes walls 66' and 68' between which is positioned a plurality of walls or partitions 138' which form side-by-side slots 140' (see, e.g., FIGS. 2 and 6) within which the spring contact portions 88 move during insertion and removal of modular plug 18 in cavity 14.

Figure 3:
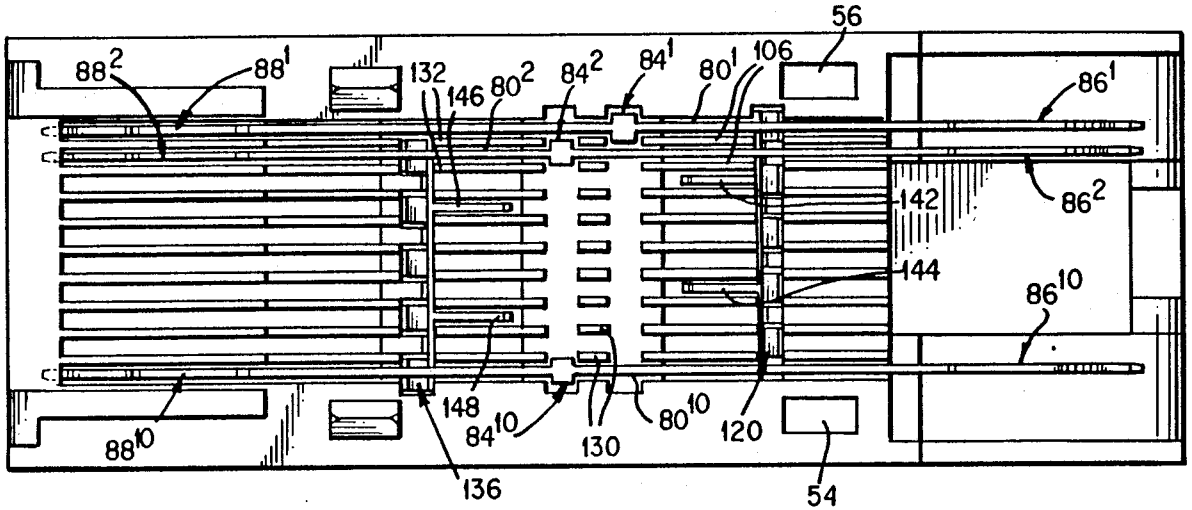
FIG. 3 is a top view illustrating one of the housing halves together with conductors and commoning bar assemblies of the present invention which is taken along line 3—3 of FIG. 1.
Figure 4:
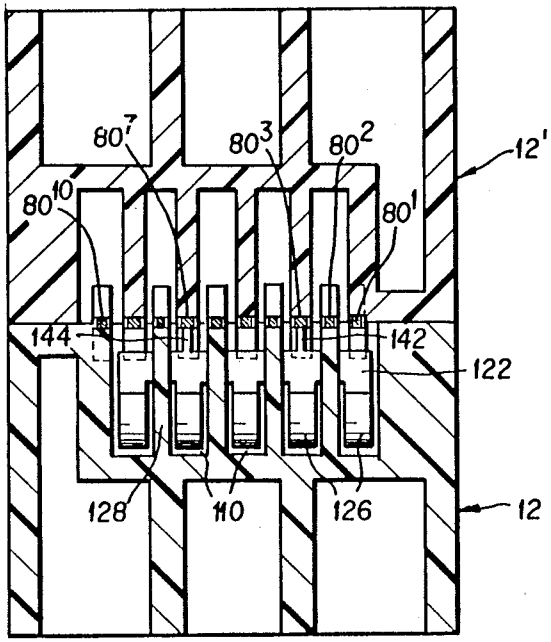
FIG. 4 is a cross-sectional view taken along line 4—4 of FIG. 2.

Referring now to FIGS. 3 and 4, by way of example three conductors $80^1$, $80^2$ and $80^{10}$ are illustrated, each having spring contact portions $86^1$, $86^2$ and $86^{10}$, respectively, and alternating-position retaining tabs $84^1$, $84^2$ and $84^{10}$. It may be appreciated from FIG. 3 how the alternating retaining tabs 84 cooperate with dividers 130 and partitions 106 and 132 to help position conductors 80. Two commoning bar assemblies 120 and 136 are illustrated in position within transverse recesses 110 and 134, respectively. In the illustrated example, commoning bar assembly 120 has had all spring contact fingers severed except those at positions 3 and 7, namely, fingers 142 and 144. Similarly, commoning bar assembly 136 has had all spring contact fingers severed except those at positions 4 and 8, namely fingers 146 and 148. Therefore, the conductors 80 at positions 3 and 7 will be commoned together by commoning bar assembly 120, while commoning bar assembly 136 will connect conductors 80 at positions 4 and 8 together.

FIG. 4 illustrates commoning bar assembly 120 together with all conductors 80 illustrated in cross-section. Underneath conductors $80^3$ and $80^7$ are positioned spring contact fingers 142 and 144 for commoning those two conductors together. By utilizing two commoning bar assemblies 120 and 136, two sets of different common connections may be effected, even if they overlap, which would not be possible if a single commoning bar assembly were utilized.

In assembling the device of the present invention, the commoning bar assembly is initially severed from its lead frame whereafter those contact positions not desired to be commoned are cut off. Forming tools then bend the retaining portions 126 into a U-shape, whereafter the assembly is inserted into one of the recesses in the lower housing half. The remaining fingers 124 are then bent over to provide the desired spring contact resiliency. The main lead frame conductors 80 are then loaded into the top half 12' of the housing, whereafter the two housing halves are snapped together.

It may be appreciated by virtue of the foregoing that there has been described a distinct improvement over prior modular connector couplers for directly coupling a pair of modular plugs. Particularly, the point of flexure of the spring contact portion of the conductors of the present invention resides above the area of contact with the plug's terminals and above the plug-receiving opening. Thus, if a smaller plug is accidentally inserted into the plug-receiving cavity and strikes one of the spring contacts, the latter, while being flexed somewhat, cannot be overstressed, due to the high placement of the moment arm. Only the mating surface of the spring contact portion and its leads are exposed below the guide slots and ceiling of the plug receiving cavities, the point of flexure being enclosed and protected in the housing.

Additionally, a substantially uniform contact resistance is achieved with the present invention since the spring contact portion mates on the upper, linear and horizontal surface of the contact terminal of the male plug regardless of its particular position within the female jack.

Furthermore, the flatened bottom of the spring contact portion, in the preferred embodiment, provides a substantially rectangular or quadrilateral area of contact with the male blade, which, in turn, provides a better transfer window for high frequency signals.

The unique commoning bar assembly of the present invention ensures a high degree of integrity by providing movable and flexible spring contact fingers that maintain substantially continuous electrical contact with the chosen conductors of the main lead frame.

The housing halves of the present invention, being identical to one another, also provide substantial economies in terms of molds, inventory, and ease of assembly.

Obviously, numerous modifications and variations of the present invention are possible in light of the above teachings. For example, even though the illustrated modular plugs are reverse oriented to provide a positionally matched coupler (i.e., a signal on position 1 on plug 18 is transmitted to position 1 on plug 20), a positionally transposed configuration is possible wherein a signal on position 1 on one of the modular plugs would be transposed to position 10 on the other modular plug. Thus, it is to be understood that within the scope of the appended claims, the invention may be practiced otherwise than as specifically described herein.

I claim:

1. A modular jack for receiving a modular plug of the type which includes a dielectric housing having a free end for insertion into the modular jack, a cord input end having a cavity for receiving a multi-conductor cord, a resilient latching arm integrally connected by a flexible hinge to the free end of the dielectric housing and extending obliquely rearwardly therefrom, a terminal-receiving side having partitions which define side-by-side slots in communication with the cavity, electrically conductive contact terminals positioned within the slots and extending into the cavity for making electrical engagement with associated conductors of the cord, the contact terminals including insulation-piercing tangs at the lower portion thereof and an outer edge surface, the modular jack comprising:

(a) an insulating housing having a front end and a rear end;

(b) plug-receiving cavity means for receiving the modular plug extending into said front end of said insulating housing and having a plurality of internal walls including a rear wall;

(c) a wall member extending adjacent said rear wall of said plug-receiving cavity means and having conductor-receiving means formed therein;

(d) a plurality of electrical conductors in side-by-side spaced-apart relationship in said insulating housing, each of said conductors comprising:

(i) a first portion positioned in said conductor receiving means of said supporting wall; and (ii) a spring contact portion extending from said front end toward said rear end of said housing from said first portion into said plug-receiving cavity means;

(e) commoning bar assembly means positioned adjacent said conductor-receiving means of said wall member and including means for maintaining continuous electrical contact between at least two conductors which may be preselected from said plurality of electrical conductor; said commoning bar assembly means maintaining continuous electrical contact between said conductors when a plug is inserted into said plug receiving cavity means;

(f) said spring contact portions of said conductors engaging the contact terminals of the modular plugs after insertion of the plug into said plug-receiving cavity means; and (g) said plug-receiving cavity means further having recess means formed therein for receiving and releasably retaining the latching arm of the modular plug.

2. The modular jack of claim 1, wherein said means for maintaining continuous electrical contact comprises at least two conductive fingers in spring contact engagement with said at least two of said plurality of electrical conductors.

3. The modular jack of claim 2, wherein said commoning bar assembly means further comprises an elongated conductive strip extending transversely of and adjacent to said first portions of said conductors, said at least two conductive fingers extending integrally from said conductive strip.

4. The modular jack of claim 3, wherein said commoning bar assembly further comprises means for mounting and retaining same in said insulating housing.

5. The modular jack of claim 4, wherein said mounting and retaining means comprises a plurality of retaining legs formed integrally with said conductive strip and extending therefrom.

6. The modular jack of claim 1, wherein said spring contact portion extends from said first portion into said plug-receiving cavity means from said rear wall of said cavity means towards said front end of said insulating housing.

7. The modular jack of claim 6, wherein said outer edge surface of said contact terminal comprises a flat upper edge and wherein said spring contact portions of said conductors include a substantially linear lower surface for engaging said flat upper edge of said contact terminals.

8. A double-ended modular jack for coupling two modular plugs, each of the modular plugs being of the type which includes a dielectric housing having a free end for insertion into the modular jack, a cord input end having a cavity for receiving a multi-conductor cord, a resilient latching arm integrally connected by a flexible hinge to the free end of the dielectric housing and extending obliquely rearwardly therefrom, a terminal-receiving side having partitions which define side-by-side slots in communication with the cavity, electrically conductive contact terminals positioned within the slots and extending into the cavity for making electrical engagement with associated conductors of the cord, the contact terminals including insulation-piercing tangs at the lower portion thereof and a substantially flat portion of an upper edge surface on at least one end of which is formed a crown, the modular jack comprising:

(a) an insulating housing having first and second ends and a central housing portion;

(b) first and second plug-receiving cavity means for receiving the modular plugs extending into said first and second ends of said insulating housing, each cavity means having a rear wall and a plurality of internal side walls;

(c) conductor-receiving means extending through said central housing portion from said first to said second plug-receiving cavity means;

(d) a plurality of electrical conductors in side-by-side spaced-apart relationship, each of said conductors comprising:

(i) a central portion extending through said conductor-receiving means of said housing; and (ii) first and second spring contact portions extending from said central portion into said first and second plug-receiving cavity means, respectively, in the direction of the first and second ends of said housing;

(e) commoning bar assembly means positioned adjacent said conductor-receiving means and including means for maintaining continuous electrical contact between at least two conductors which may be preselected from said plurality of electrical conductors said commoning bar assembly means maintaining continuous electrical contact between said conductors when said plugs are inserted into said plug receiving cavity means;

(f) said spring contact portions of said conductors including a mating surface for engaging the contact terminals of the modular plugs after insertion of the plugs into said plug-receiving cavity means; and (g) said plug-receiving cavity means each further having recess means formed therein for receiving and releasably retaining the latching arms of the modular plugs.

9. The double-ended modular jack as set forth in claim 8, wherein said first and second spring contact portions extend from said central portion of said conductors into said first and second cavity means, respectively, from said rear wall of said cavity means towards said first and second ends of said insulating housing, respectively.

10. The double-ended modular jack of claim 8, wherein said conductors comprise stamped-and-formed contacts, said mating surface of said spring contact portion including a substantially flat lower surface for contacting said flat upper edge surface of said contact terminal, whereby the resultant contact area between said spring contact portion and said contact terminal when in normal alignment comprises a quadrilateral.

11. The double-ended modular jack of claim 8, wherein said conductors comprise round wires, said mating surface of said spring contact portion including a rounded outer surface for contacting said flat upper edge surface of said contact terminal, whereby the resultant contact area between said spring contact portion and said contact terminal, when in normal alignment, comprises a substantially thin elongated line.

12. The double-ended modular jack as set forth in claim 8, wherein said means for maintaining continuous electrical contact comprises at least two conductive fingers in spring contact engagement with said at least two of said plurality of electrical conductors.

13. The double-ended modular jack as set forth in claim 12, wherein said commoning bar assembly means further comprises an elongated conductive strip extending transversely of and adjacent to said central portions of said conductors, said at least two conductive fingers being formed integrally with and extending from said conductive strip.

14. The double-ended modular jack as set forth in claim 13, wherein said commoning bar assembly means further comprises means for mounting and retaining same in said insulating housing.

* * * * *